US007866197B2

(12) United States Patent
Wang

(10) Patent No.: US 7,866,197 B2
(45) Date of Patent: Jan. 11, 2011

(54) ROLLING-CIRCLE MACHINE

(75) Inventor: Chung-Pei Wang, Taipei Hsien (TW)

(73) Assignee: Hon Hai Precision Co., Ltd., Tu-Cheng, Taipei Hsien (TW)

( * ) Notice: Subject to any disclaimer, the term of this patent is extended or adjusted under 35 U.S.C. 154(b) by 15 days.

(21) Appl. No.: 12/192,348

(22) Filed: Aug. 15, 2008

(65) Prior Publication Data

US 2009/0107198 A1 Apr. 30, 2009

(30) Foreign Application Priority Data

Oct. 31, 2007 (CN) ..... 200710202319

(51) Int. Cl.
*B21D 17/04* (2006.01)

(52) U.S. Cl. ..... 72/88; 72/469; 72/481.3; 470/185

(58) Field of Classification Search ..... 269/43, 269/45, 73; 29/281.1; 72/125, 214, 220, 72/481.3, 481.6, 481.7, 468, 478, 77, 88, 72/90, 93, 237, 238, 473, 469; 470/66, 82, 470/185, 190

See application file for complete search history.

(56) References Cited

U.S. PATENT DOCUMENTS 1,449,483 A * 3/1923 Adams ..... 72/93
1,965,489 A * 7/1934 Coates ..... 72/93
1,968,124 A * 7/1934 Cate ..... 72/94
2,325,522 A * 7/1943 Lauer et al. ..... 72/126
2,496,790 A * 2/1950 Guarnaschelli ..... 72/112
2,662,433 A * 12/1953 Braun ..... 269/153
3,277,684 A * 10/1966 Gareri ..... 72/105
3,336,659 A * 8/1967 Staples et al. ..... 29/512
3,656,332 A * 4/1972 Marcovitch ..... 72/77
4,514,997 A * 5/1985 Zifferer ..... 72/68
6,530,254 B2 3/2003 Beierling
7,055,360 B2 * 6/2006 Hamerski et al. ..... 72/379.2

* cited by examiner

*Primary Examiner*—Edward Tolan
(74) *Attorney, Agent, or Firm*—Andrew C. Cheng

(57) ABSTRACT

A rolling-circle machine for rolling a workpiece includes at least one first rolling portion, a second rolling portion connected to the first rolling portion, and at least one adjusting screw. The first rolling portion includes one or more first concaved sections for rolling the workpiece and at least a through hole. The second rolling portion includes one or more second concaved sections for rolling the workpiece. The second concaved section forms one or more rolling slots in cooperation with the first concaved section. The adjusting screw includes a threaded post passing through the through hole of the first rolling portion and one end of the threaded post is fixed in the second rolling portion. The adjusting screw is configured for adjusting a distance between the first and the second rolling portion to roll workpieces that have different dimensions.

11 Claims, 6 Drawing Sheets

ROLLING-CIRCLE MACHINE

BACKGROUND

1. Technical Field

The present invention relates to a rolling-circle machine, and, particularly, to a rolling-circle machine for rolling workpieces having different dimensions.

2. Description of Related Art

A typical rolling-circle machine includes a fixing portion 1 as shown in FIG. 5 and a rolling portion 2 as shown in FIG. 6. The fixing portion 1 has a V-shaped groove 3 for fixing a workpiece 30. The rolling portion 2 has an arc-shaped groove 4 for rolling the workpiece 30. The arc-shaped groove 4 is dimensioned according to a dimension of the workpiece 30. However, a single rolling portion 2 cannot roll different workpieces 30 with different dimensions. Therefore, different rolling portions 2 would be needed for different workpieces 30, which results in increased costs for creating the different rolling portions 2 and time spent changing the different rolling portions 2 for the different workpieces 30.

Therefore an improved rolling-circle machine is desired to overcome the above-described deficiency.

SUMMARY

In accordance with the present invention, a rolling-circle machine includes at least one first rolling portion, a second rolling portion, and at least one adjusting screw. The at least one first rolling portion includes at least one first concaved section for rolling the workpiece and at least one through hole extending along a direction perpendicular to the at least one first concaved section. The second rolling portion includes at least one second concaved section for rolling the workpiece. Each of the at least one second concaved section forms a rolling slot for rolling the workpiece in cooperation with the corresponding at least one first concaved section. The at least one adjusting screw includes a threaded post. The threaded post passes through the through hole of the first rolling portion. A first end of the threaded post is fixed in the second rolling portion, and the adjusting screw is configured for moving the first rolling portion back and forth to adjust a distance between the at least one first rolling portion and the second rolling portion.

Other novel features and advantages will become more apparent from the following detailed description when taken in conjunction with the accompanying drawings.

BRIEF DESCRIPTION OF THE DRAWINGS

The present invention is described in detail, by way of example and description of preferred and exemplary embodiments with reference to the accompanying drawings, in which.

DETAILED DESCRIPTION OF EXEMPLARY EMBODIMENTS

A detailed explanation of a rolling-circle machine according to the exemplary embodiments will now be made with reference to the drawings attached hereto.

Figure 1:
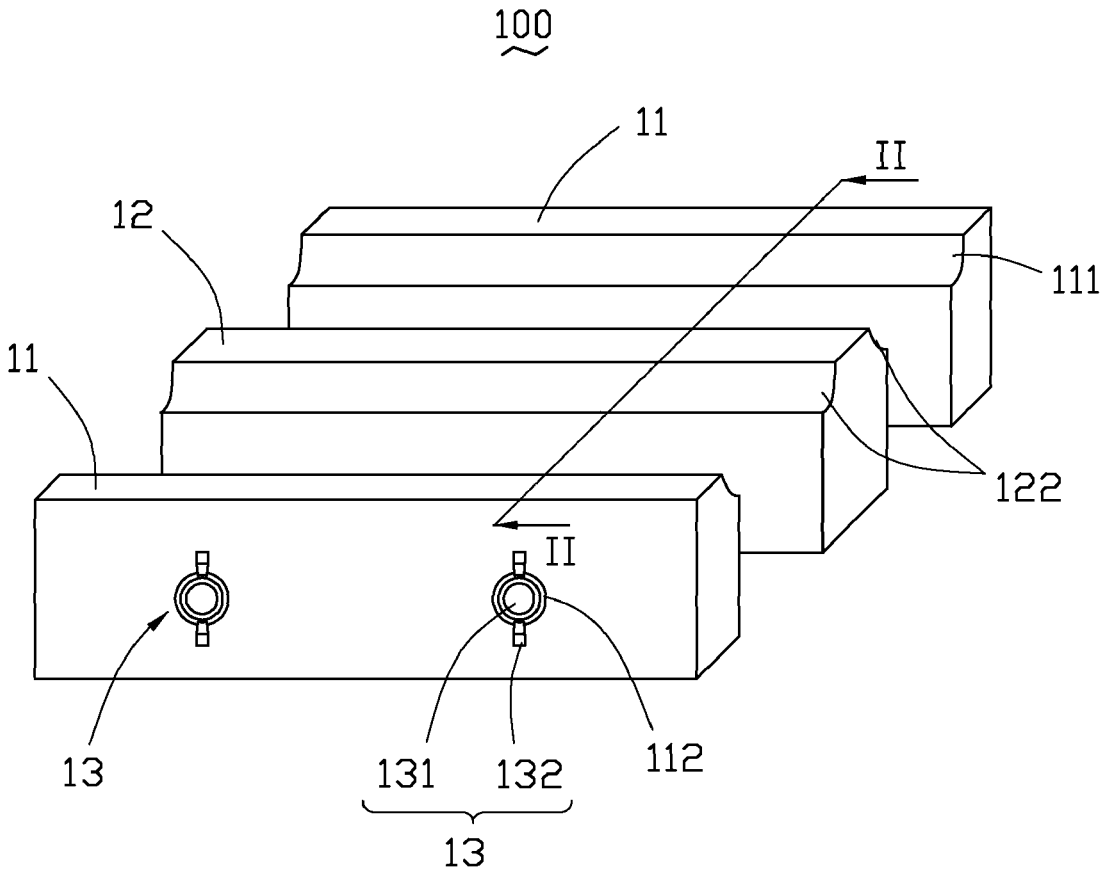
FIG. 1 is an isometric view of a first embodiment of a rolling-circle machine.

Referring to FIG. 1, a rolling-circle machine 100 according to a first embodiment of the present invention includes two first rolling portions 11, a second rolling portion 12 positioned between the two first rolling portions 11, and at least one adjusting screws 13 extending through the first rolling portion 11 and fixed to the second rolling portion 12. In another embodiment, the rolling-circle machine 100 may only include one first rolling portion 11.

Figure 2:
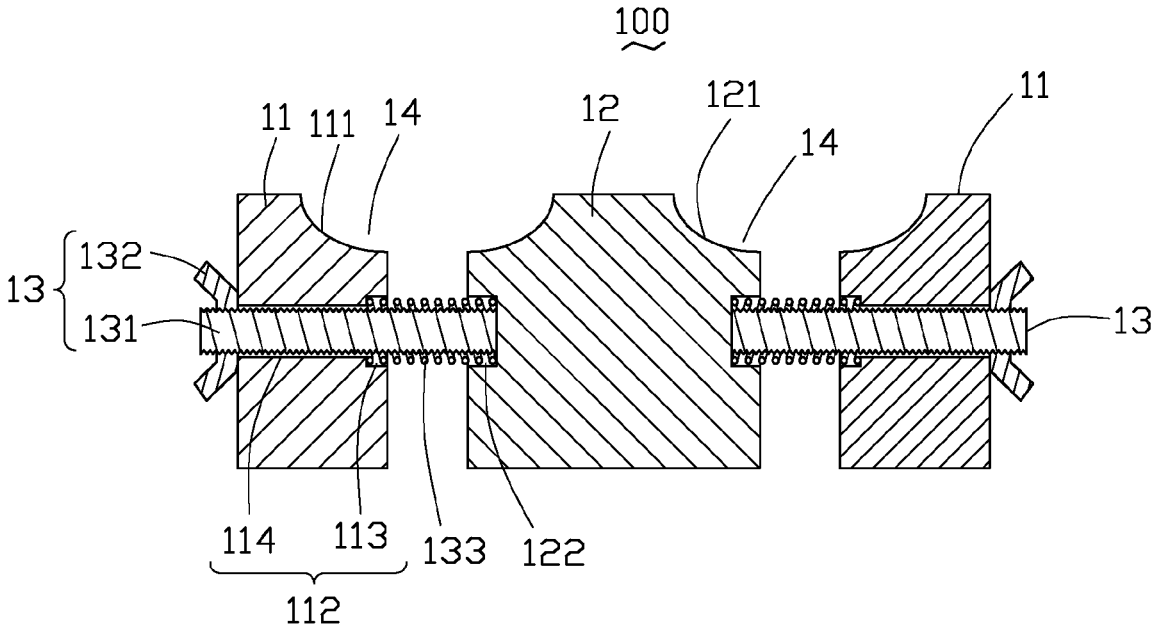
FIG. 2 is a cross-sectional view of the rolling-circle machine of FIG. 1, taken along II-II line.

Referring to FIG. 2, each first rolling portion 11 includes an elongated first concaved section 111 at a top surface and at least one through hole 112 defined in a side surface and extending in a direction perpendicular to the top surface. In the embodiment of FIG. 1, the first concaved section 111 is arc-shaped. The through hole 112 is a stepped-shaped hole and includes an enlarged portion 113 and a narrow portion 114 connected to the enlarged portion 113. In this embodiment, each of the first rolling portion 11 defines two through holes 112 therein.

The second rolling portion 12 includes at least one elongated second concaved section 121 and at least one cavity 122 defined in a surface of the second rolling portion corresponding to each through hole 112. In the embodiment of FIG. 1, the second rolling portion 12 is positioned between the two first rolling portions 110, thereby forming two rolling slots 14 defined by the two second concaved sections 121 and the two first concaved sections 111.

Each adjusting screw 13 includes a threaded post 131 and a nut 132. The threaded post 131 passes through the through hole 112 of the first rolling portion 11 with a first end of the threaded post 131 fixed to the second rolling portion 12. The nut 132 is threadedly engaged at an opposite second end of the threaded post 131 for adjusting the first rolling portion 11 back and forth by loosening or tightening the nut 132. The adjusting screw 13 further includes a spring 133 wrapped around a portion of the threaded post 131. The spring 133 is configured to press against the first and the second rolling portions 11, 12 thereby pushing the first rolling portion 11 against the nut 132. A first end of the spring 133 is received in the enlarged portion 113 and an opposite second end of the spring 133 is received in the cavity 122 of the second rolling portion 12.

In use, the distance between the first and second rolling portions 11, 12 of the rolling-circle machine 100 can be adjusted via the nut 132 correspond to the dimension of the workpiece. Thus, the rolling-circle machine 100 can be used for rolling different workpieces with different dimensions.

Figure 3:
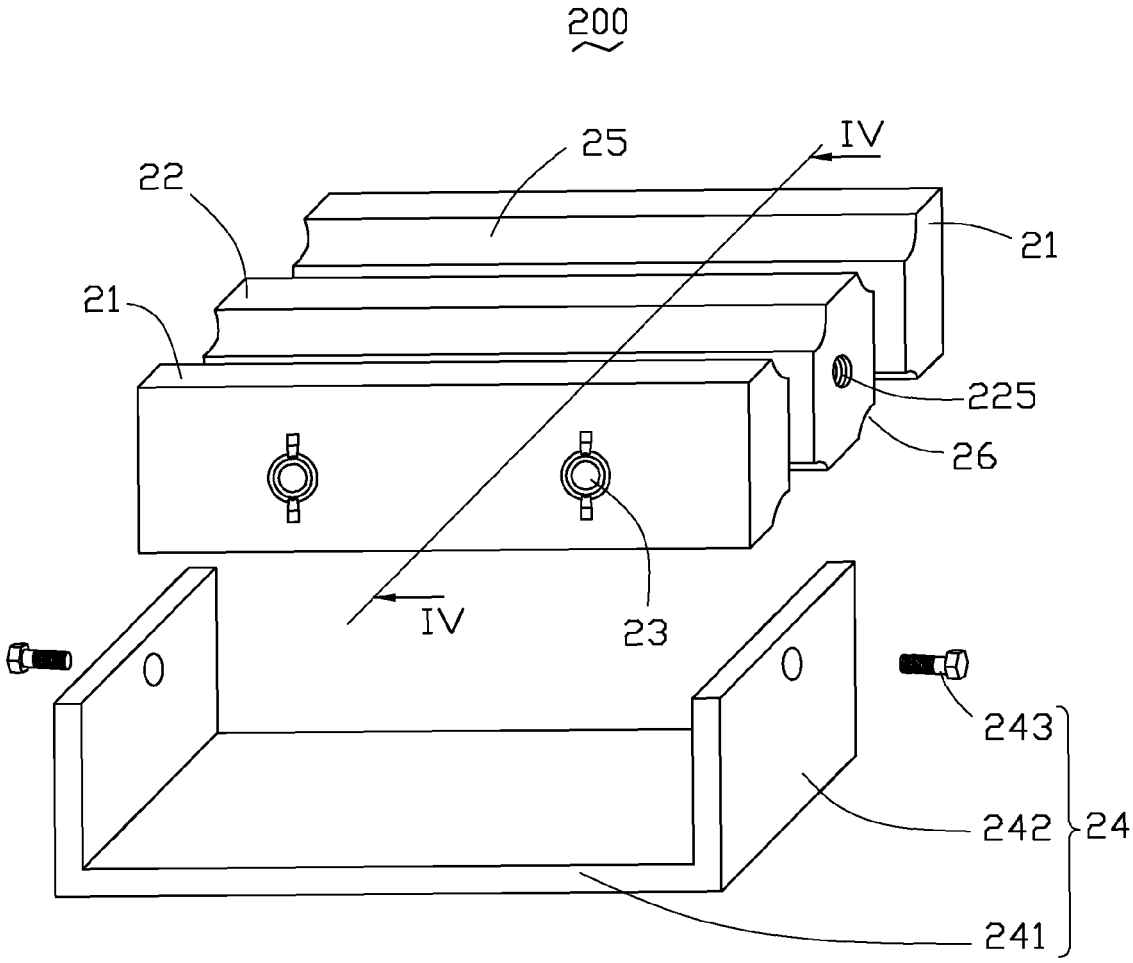
FIG. 3 is an isometric view of a second embodiment of a rolling-circle machine.
Figure 4:
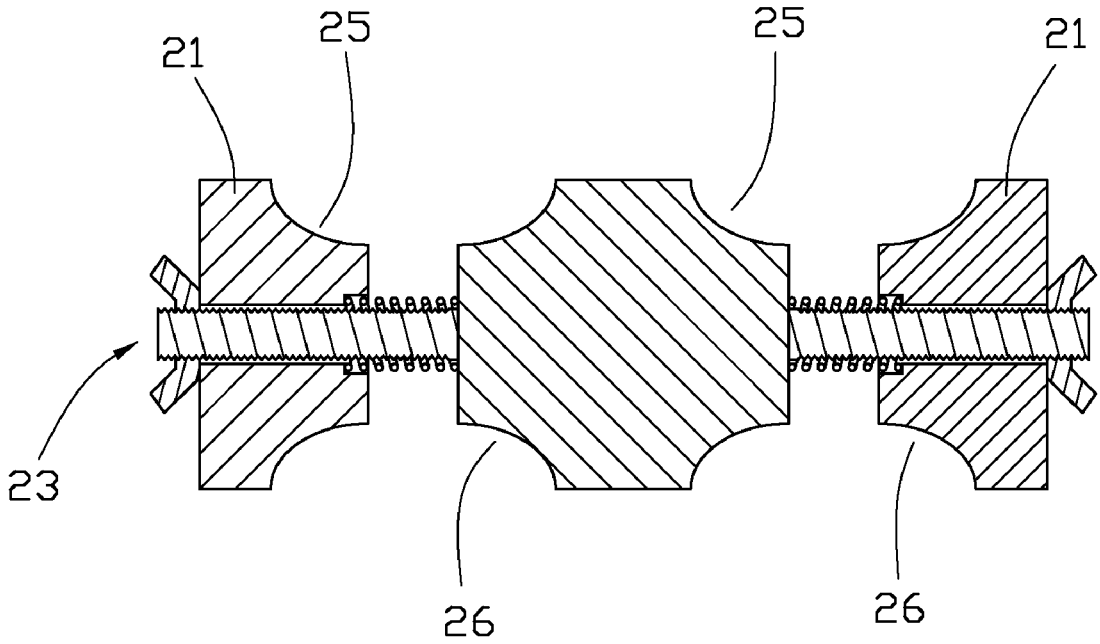
FIG. 4 is a cross-sectional of the rolling-circle machine of FIG. 3, taken along IV-IV line.
Figure 5:
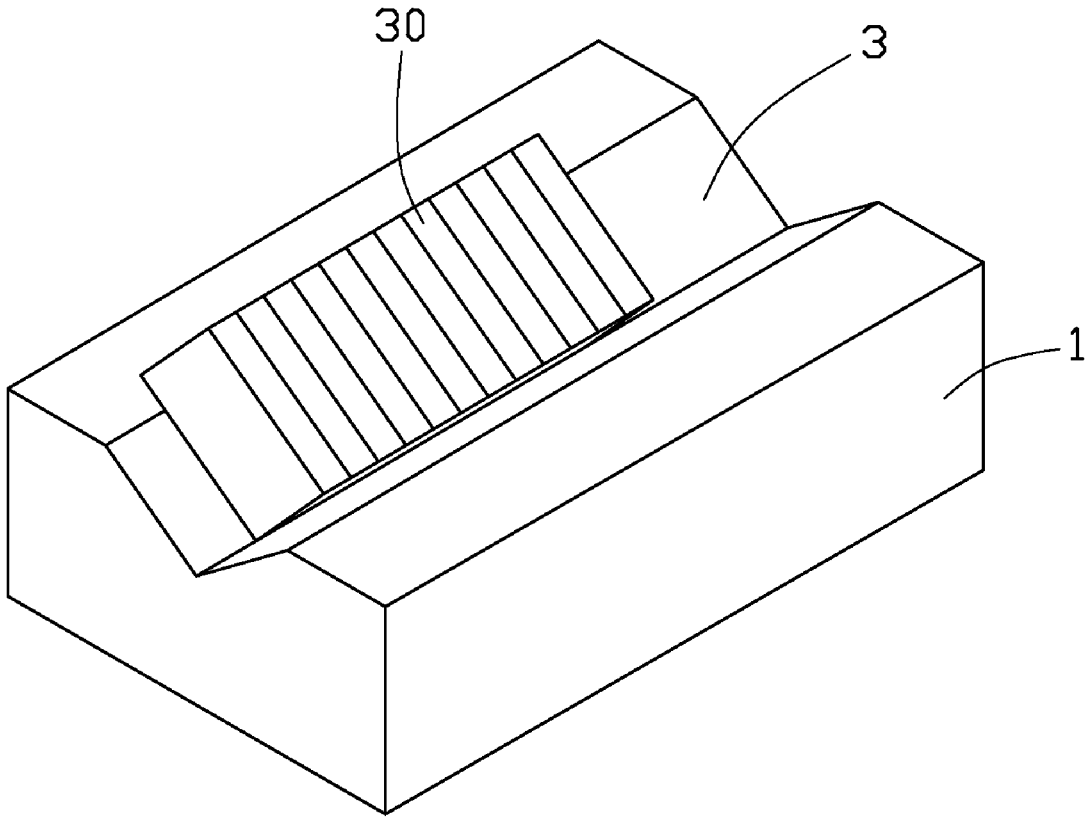
FIG. 5 (RELATED ART)
FIG. 5 is a isometric view of a fixing portion of a typical rolling-circle machine.
Figure 6:
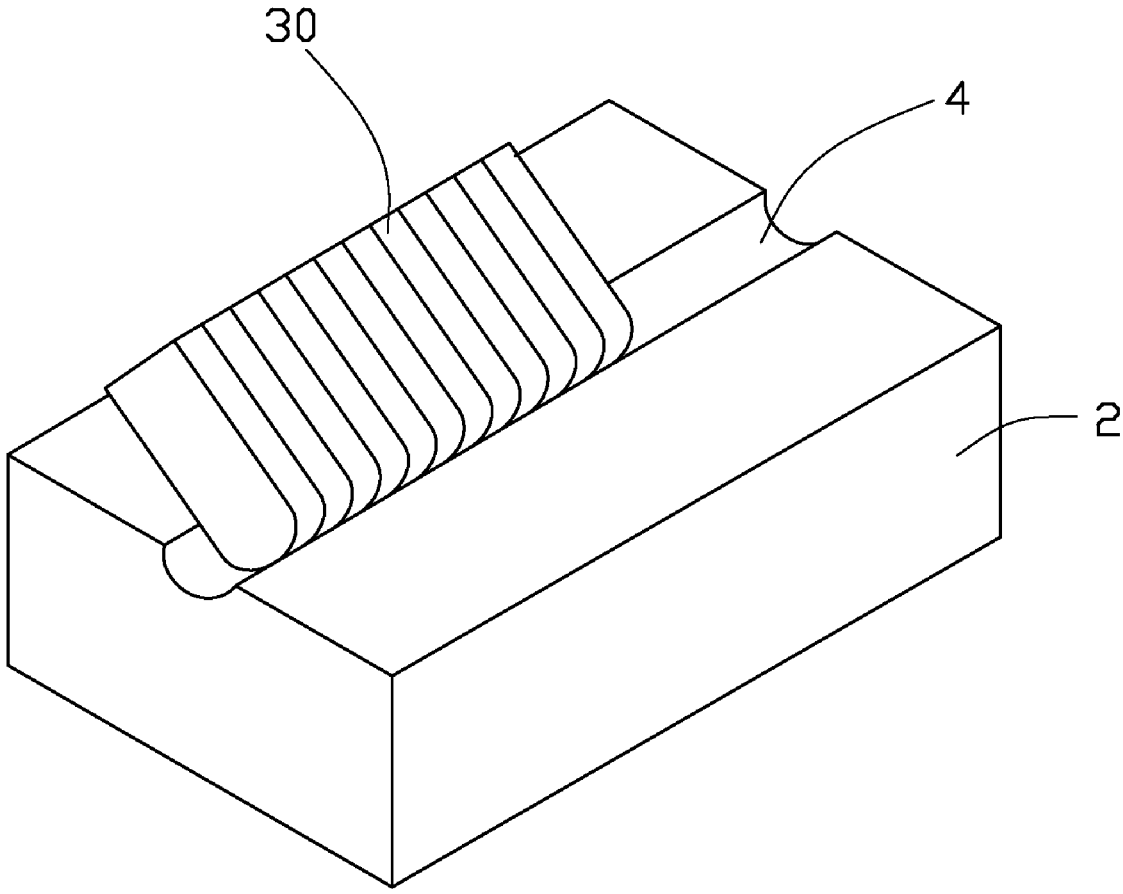
FIG. 6 (RELATED ART)
FIG. 6 is an isometric view of a rolling portion of the typical rolling-circle machine of FIG. 5.

Referring to FIG. 3, a rolling-circle machine 200 according to a second embodiment includes two first rolling portions 21, a second rolling portions 22 positioned between the two first rolling portions 21, at least one adjusting screw 23 extending through the first rolling portion 21 and fixed on the second rolling portion 22, and a U-shaped carrier assembly 24 connected to the second rolling portions 22.

The first and second rolling portions 21, 22 of the second embodiment are identical to the first and second rolling portions 11, 12 of the first embodiment except that the first and second rolling portions 21, 22 have two groups of rolling slots 25, 26 defined at opposite sides of the first and second rolling portions 21, 22. The two groups of rolling slots 25, 26 have different dimensions for rolling different workpieces.

The carrier assembly 24 includes a base 241, two restraining plates 242 extending perpendicularly at two opposite ends of the base 241 and each plate defining a through hole (not labeled), and two rotating screws 243. The two rotating screws 243 are configured for fixing the second rolling portion 22 to adjust the position of rolling slots 25, 26 for rolling different workpieces. The second rolling potion 22 includes two tapped holes 225 for threadedly engaging with the two rotating screws 243.

As described above, when rolling workpiece have different dimensions, the rolling-circle machine 200 can adjust the position of the rolling slots 25, 26 relative to the U-shaped carrier assembly 24 via the two rotating screws 243. Distance between the first and second rolling portions 21, 22 of the rolling-circle machine 200 can be adjusted via the adjusting screw 23. Thus, the rolling-circle machine 200 can be used for rolling different workpieces with different dimensions.

It should be understood that the above-described embodiment is intended to illustrate rather than limit the invention. Variations may be made to the embodiments without departing from the spirit of the invention. Accordingly, it is appropriate that the appended claims be construed broadly and in a manner consistent with the scope of the invention.

What is claimed is:

1. A rolling-circle machine, comprising:

a first rolling portion comprising:

an elongate first concaved section for rolling the workpiece, the first concaved section extending along a first direction; and at least one through hole extending along a second direction perpendicular to the first direction;

a second rolling portion comprising an elongate second concaved section for rolling the workpiece, wherein the second concaved section is positioned to face the first concaved section of the first rolling portion such that only the second concaved section and the first concaved section cooperatively form a rolling slot for rolling the workpiece, the rolling slot extending along the first direction, and the rolling slot being an open slot with an opening at a top thereof providing for insertion of the workpiece from outside the rolling-circle machine into the rolling slot in a downward direction; and at least one adjusting screw comprising a threaded post, wherein the threaded post passes through the corresponding at least one through hole of the first rolling portion, a first end of the threaded post is fixed in the second rolling portion, and the at least one adjusting screw is configured for moving the first rolling portion back and forth along an axis coinciding with the second direction to adjust a distance between the first rolling portion and the second rolling portion.

2. The rolling-circle machine of claim 1, further comprising at least one spring, each of the at least one spring wrapped around the threaded post of each at least one adjusting screw and sandwiched between the first rolling portion and the second rolling portion.

3. The rolling-circle machine of claim 2, wherein the second rolling portion defines at least one cavity for receiving a first end of the at least one spring.

4. The rolling-circle machine of claim 2, wherein the at least one through hole of the first rolling portion is a step-shaped hole.

5. The rolling-circle machine of claim 4, wherein the step-shaped hole comprises an enlarged portion for receiving one end of the corresponding at least one spring and a narrow portion connected to the enlarged portion.

6. The rolling-circle machine of claim 1, wherein the at least one adjusting screw comprises two adjusting screws positioned between the first rolling portion and the second rolling portion.

7. The rolling-circle machine of claim 1, further comprising a U-shaped carrier assembly comprising a base, two restraining plates extending perpendicularly at two opposite sides of the base, and two rotating screws positioned at the two restraining plates, wherein the two rotating screws are configured to adjust the position of the second rolling portion relative to the first rolling portion.

8. The rolling-circle machine of claim 7, wherein the second rolling portion comprises two tapped holes for respectively receiving the two rotating screws.

9. The rolling-circle machine of claim 1, wherein the second concaved section is oriented symmetrically opposite to the first concaved section.

10. The rolling-circle machine of claim 9, wherein a cross-section of the first concaved section taken along a plane coinciding with the second direction is curved, and a cross-section of the second concaved section taken along a plane coinciding with the second direction is curved.

11. The rolling-circle machine of claim 10, wherein the curvature of the second concaved section and the curvature of the first concaved section cooperatively form a curved seat for rolling the workpiece.

* * * * *